US007549627B2

(12) United States Patent
Lin et al.

(10) Patent No.: US 7,549,627 B2
(45) Date of Patent: Jun. 23, 2009

(54) AUTOMATIC DOCUMENT FEEDER CAPABLE OF ALLOWING EASY REMOVAL OF JAMMED SHEETS OF PAPER

(75) Inventors: Hsien-Chi Lin, Taichung (TW); Kung-Hsin Teng, Taichung (TW)

(73) Assignee: Asia Optical Co., Inc. (TW)

( * ) Notice: Subject to any disclaimer, the term of this patent is extended or adjusted under 35 U.S.C. 154(b) by 236 days.

(21) Appl. No.: 11/803,834

(22) Filed: May 16, 2007

(65) Prior Publication Data

US 2008/0012200 A1 Jan. 17, 2008

(30) Foreign Application Priority Data

Jul. 17, 2006 (TW) ..... 95126015 A

(51) Int. Cl.
*B65H 5/00* (2006.01)

(52) U.S. Cl. ..... 271/10.13; 271/10.01; 271/10.08; 400/185; 400/186; 400/569

(58) Field of Classification Search ..... 271/10.13, 271/10.01, 10.08, 112, 121, 272; 74/665 P, 74/342, 343; 399/51, 88, 177 SJ; 400/185, 400/186, 568, 569; 347/10, 57, 128, 132, 347/247; 358/419, 420, 421, 422, 423
See application file for complete search history.

(56) References Cited

U.S. PATENT DOCUMENTS

| | | | | |
|---|---|---|---|---|
| 4,976,557 | A * | 12/1990 | Uchikata | 400/565 |
| 5,184,902 | A * | 2/1993 | Harada et al. | 400/185 |
| 5,482,388 | A * | 1/1996 | Harada | 400/185 |
| 5,902,058 | A * | 5/1999 | Koike et al. | 400/578 |
| 6,206,368 | B1 * | 3/2001 | Kobayashi et al. | 271/273 |
| 6,578,840 | B1 * | 6/2003 | Kudo | 271/10.13 |
| 6,672,581 | B2 * | 1/2004 | Lee et al. | 271/164 |
| 6,837,489 | B2 * | 1/2005 | Kim | 271/3.14 |
| 7,306,216 | B2 * | 12/2007 | Lee et al. | 271/10.01 |

* cited by examiner

*Primary Examiner*—Kaitlin S Joerger
(74) *Attorney, Agent, or Firm*—Trop, Pruner & Hu, P.C.

(57) ABSTRACT

An automatic document feeder includes a driving wheel, a clutch unit, and a plurality of roller units. The clutch unit is disposed in a housing unit, and includes a first wheel driven by the driving wheel, a second wheel for driving the roller units, a resilient member interposed between the first and second wheels for biasing the second wheel to move away from the first wheel, and a driving rod. The driving rod is movable between a connecting position whereat the second wheel engages the first wheel so as to allow for transfer of rotation between the first and second wheels, and a disconnecting position whereat the second wheel is disengaged from the first wheel so as to prevent transfer of rotation between the first and second wheels.

9 Claims, 6 Drawing Sheets

AUTOMATIC DOCUMENT FEEDER CAPABLE OF ALLOWING EASY REMOVAL OF JAMMED SHEETS OF PAPER

CROSS-REFERENCE TO RELATED APPLICATION

This application claims priority of Taiwanese Application No. 095126015, filed on Jul. 17, 2006.

BACKGROUND OF THE INVENTION

1. Field of the Invention

This invention relates to an office machine, and more particularly to an automatic document feeder that allows for easy removal of jammed sheets of paper.

2. Description of the Related Art

Referring to FIG. 1, a conventional automatic document feeder includes a housing body 1, a top cover 101 disposed pivotally on the housing body 1, a feeding roller unit 2 disposed on the top cover 101, a conveying roller unit 3 disposed at a side of the feeding roller unit 2, an ejecting roller unit 4 disposed at an opposite side of the feeding roller unit 2, a driving unit 5 for driving the conveying roller unit 3, and a drive gear unit 6 driven by the driving unit 5. The driving unit 5 includes a motor 501 and a driving wheel 502 driven by the motor 501 to thereby rotate synchronously with the conveying roller unit 3. The drive gear unit 6 includes a first gear 601 driven by the driving wheel 502, a second gear 602 meshing with the first gear 601 for driving the feeding roller unit 2, a connecting rod 603 interconnecting the first and second gears 601, 602, a spring 604 for biasing the second gear 602 to pivot upwardly, and a third gear 605 meshing with the second gear 602 for driving the ejecting roller unit 4. When the top cover 101 is opened, the second gear 602 is biased by the spring 604 to pivot upwardly. Thus, the power connection between the driving unit 5 and the ejecting roller unit 4 is interrupted so as to allow a jammed sheet of paper to be removed from the ejecting roller unit 4. When the top cover 101 is closed, the second gear 602 is returned to the original position to thereby mesh with the third gear 605.

However, due to the power connection between the driving unit 5 and the conveying roller unit 3 during the opening of the top cover 101, a jammed sheet of paper cannot be removed from the conveying roller unit 3.

SUMMARY OF THE INVENTION

The object of this invention is to provide an automatic document feeder that can overcome the above-mentioned drawback associated with the prior art.

An automatic document feeder includes a driving wheel, a clutch unit, and a plurality of roller units. The clutch unit is disposed in a housing unit, and includes a first wheel driven by the driving wheel, a second wheel for driving the roller units, a resilient member interposed between the first and second wheels for biasing the second wheel to move away from the first wheel, and a driving rod. The driving rod is movable between a connecting position whereat the second wheel engages the first wheel so as to allow for transfer of rotation between the first and second wheels, and a disconnecting position whereat the second wheel is disengaged from the first wheel so as to prevent transfer of rotation between the first and second wheels.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
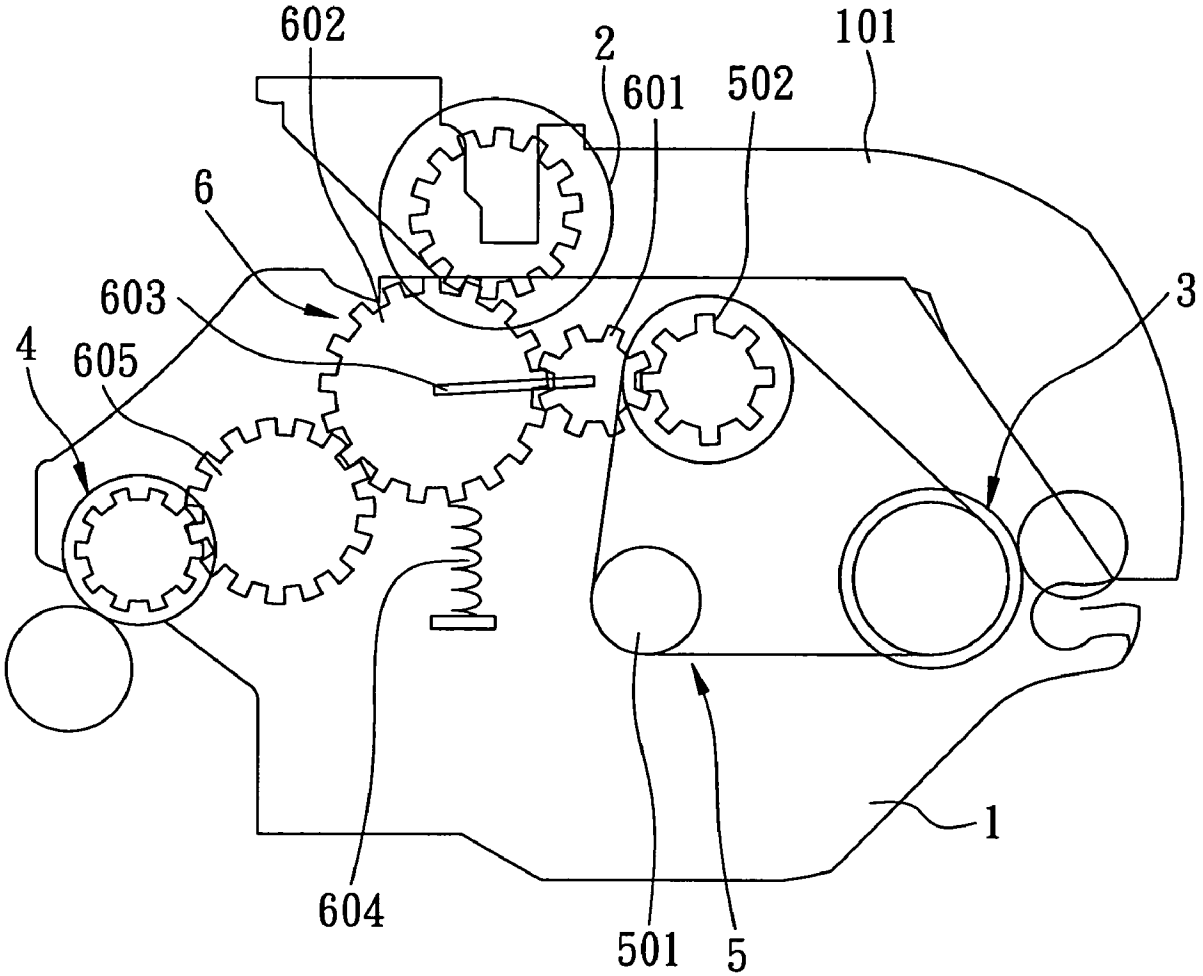
FIG. 1 PRIOR ART
FIG. 1 a schematic view of a conventional automatic document feeder.
Figure 2:
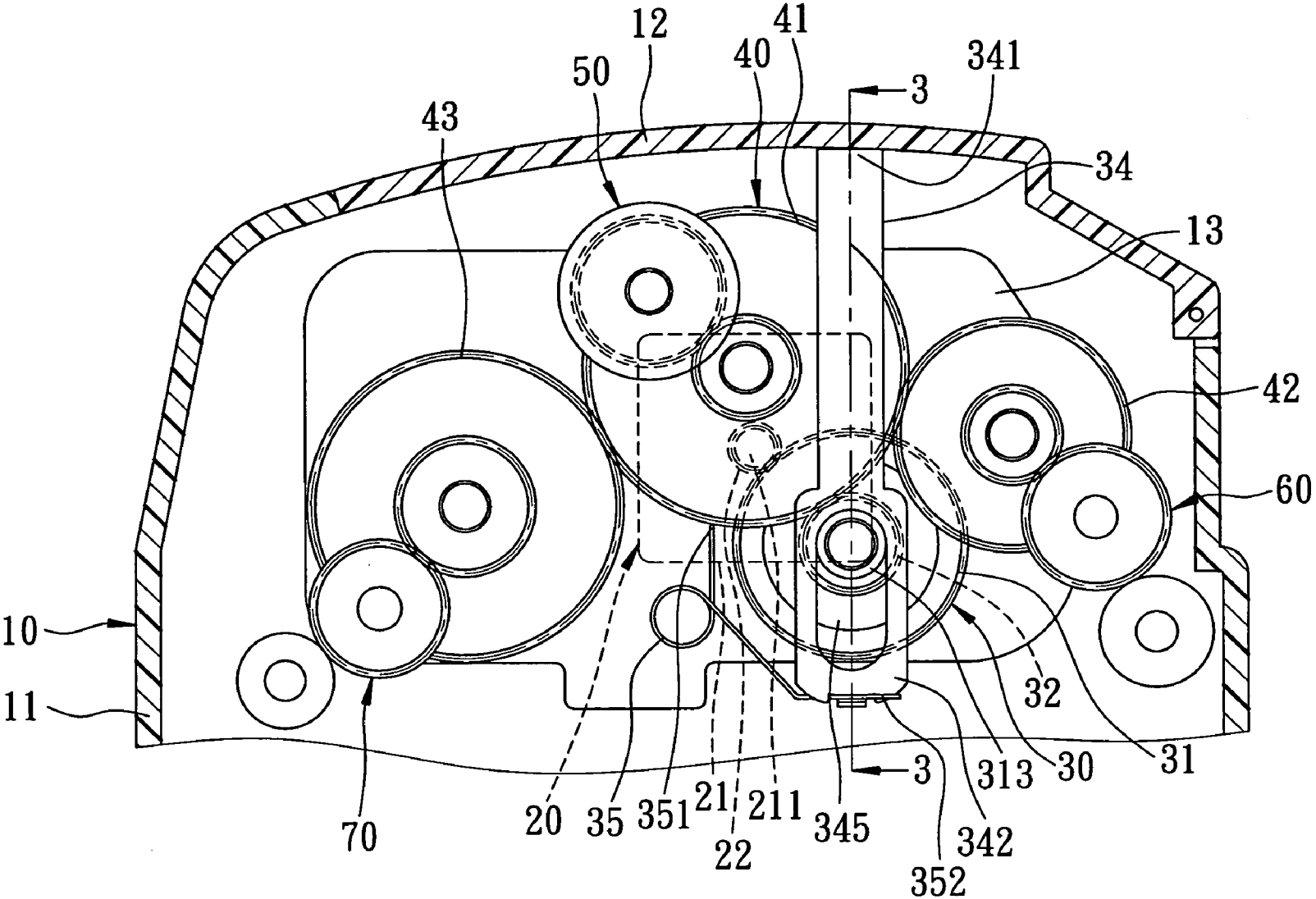
FIG. 2 is a fragmentary schematic sectional view of the preferred embodiment when a driving rod is disposed in a connecting position.

Referring to FIG. 2, the preferred embodiment of an automatic document feeder according to this invention includes a housing unit 10, a driving unit 20, a clutch unit 30, a drive gear unit 40, a first roller unit 50, a second roller unit 60, and a third roller unit 70. The housing unit 10 includes a housing body 11, a top cover 12 disposed pivotally on the housing body 11, and a mounting plate 13 disposed fixedly in the housing body 11.

The driving unit 20 includes a motor 21 disposed on the mounting plate 13, and a driving wheel 22 in the form of a gear. The motor 21 has an output shaft 211. The driving wheel 22 is sleeved fixedly on the output shaft 211.

Figure 3:
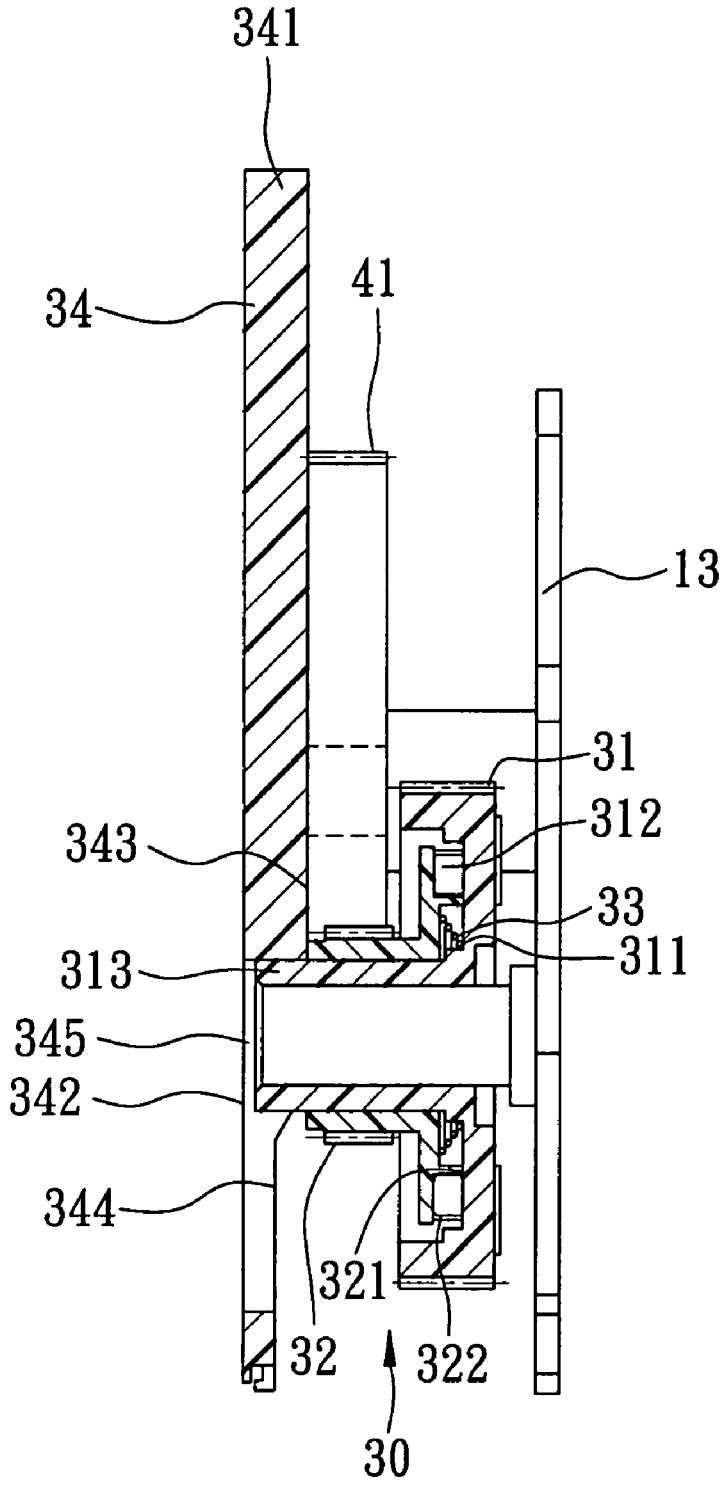
FIG. 3 is a sectional view taken along Line 3-3 in FIG. 2.
Figure 4:
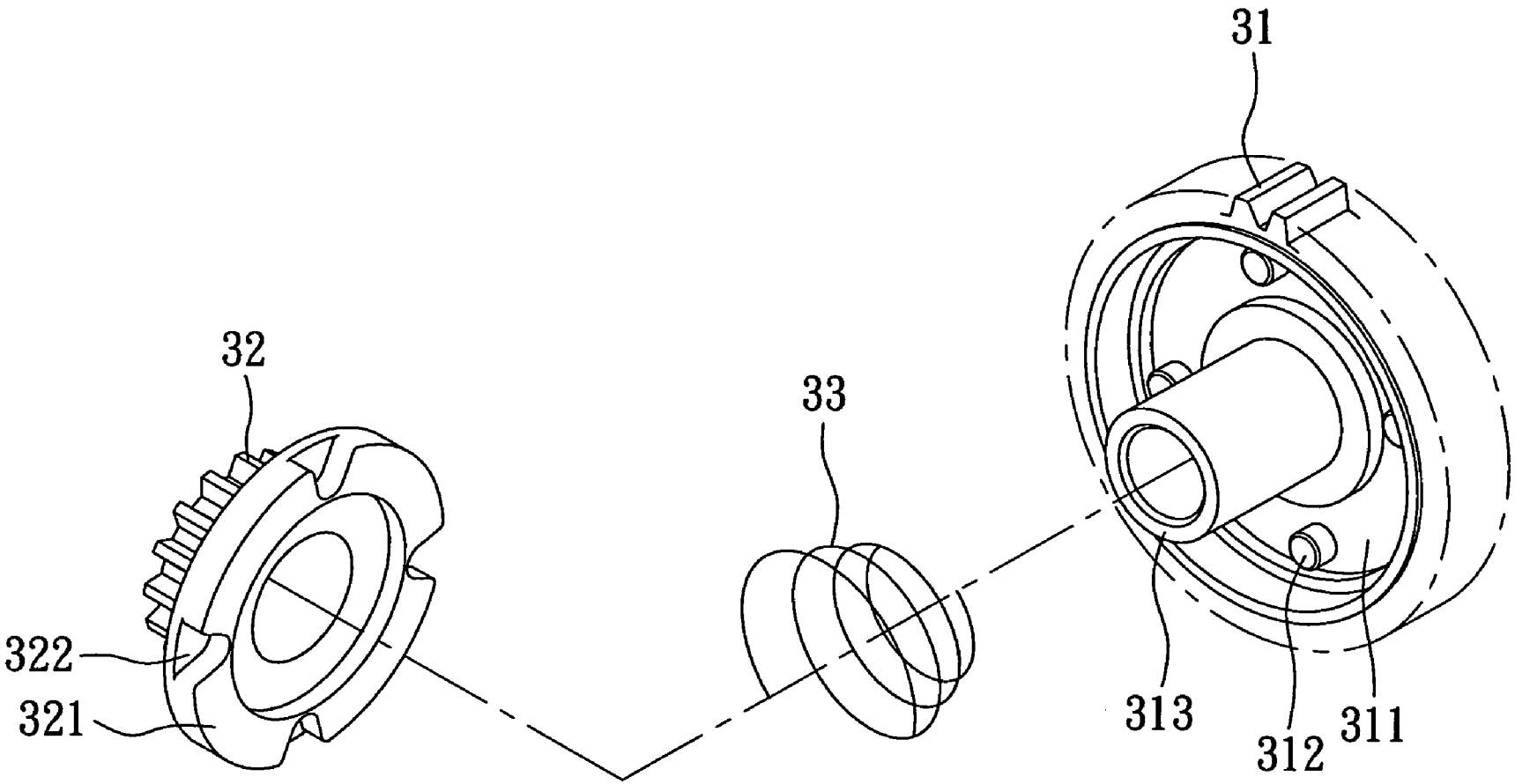
FIG. 4 is an exploded perspective view of a spring and a pair of first and second wheels of the preferred embodiment.

With further reference to FIGS. 3 and 4, the clutch unit 30 is disposed in the housing unit 10, and includes a first wheel 31 disposed rotatably on the mounting plate 13 and driven by the driving wheel 22, a second wheel 32 disposed rotatably on the mounting plate 13 and in proximity to the first wheel 31 and coaxial with the first wheel 31, a resilient member 33 configured as a coiled compression spring and interposed between the first and second wheels 31, 32, a vertical driving rod 34, and a biasing member 35 configured as a torsional spring.

The first and second wheels 31, 32 are configured as gears.

The first wheel 31 has an engagement surface 311 formed with a plurality of first engaging portions 312 configured as cylindrical projections, and a guide tube 313 extending from a central portion of the engagement surface 311.

The second wheel 32 is sleeved movably on the guide tube 313 of the first wheel 31, and has an engagement surface 321 formed with a plurality of second engaging portions 322 configured as recesses. The second engaging portions 322 are formed along a periphery of the engagement surface 321, and are aligned respectively with the first engaging portions 312.

The resilient member 33 is interposed between the engagement surfaces 311, 321 of the first and second wheels 31, 32 so as to bias the first and second wheels 31, 32 to move away from each other. The driving rod 34 has an upper end portion 341 biased by the biasing member 35 to abut against the top cover 12, and a lower end portion 342. The lower end portion 342 has a thick rod portion 343, a thin rod portion 344 disposed under the thick rod portion 343, a guide slot 345 extending from the thick rod portion 343 into the thin rod portion 344, and an inclined guiding surface 346 (see FIG. 6) disposed between the thick and thin rod portions 343, 344. An end of the guide tube 313 is received slidably within the guide slot 345. The second wheel 32 is movable on the inclined guiding surface 346, as well as on the thick and thin rod portions 343, 344. The inclined guiding surface 346 guides the second wheel 32 to move between the thick and thin rod portions 343, 344.

The biasing member 35 is disposed pivotally on the housing unit 10, and has a first end 351 abutting against the housing unit 10, and a second end 352 abutting against a lower end of the driving rod 34 so as to bias the driving rod 34 to move upwardly to thereby abut against the top cover 12.

The drive gear unit 40 is disposed on the mounting plate 13, and includes a first driving gear 41 driven by the second wheel 32, and a pair of second and third driving gears 42, 43 driven by the first driving gear 41.

The first, second, and third roller units 50, 60, 70 are disposed on the mounting plate 13.

The first roller unit 50 is driven by the first driving gear 41, and is used to separate documents (not shown).

The second roller unit 60 is driven by the second driving gear 42, and is used to convey the documents.

The third roller unit 70 is driven by the third driving gear 43, and is used to eject the documents.

With particular reference to FIGS. 2 and 3, in normal use, the top cover 12 is disposed in a closed position, and the driving rod 34 is disposed in a connecting position. In the connecting position, the second wheel 32 comes into contact with the thick rod portion 343 of the driving rod 34. As such, the second engaging portions 322 of the second wheel 32 engage respectively the first engaging portions 312 of the first wheel 31 so as to allow for transfer of rotation of the first wheel 31 to the second wheel 32. In this state, when the motor 21 is started, the driving wheel 22 rotates the first wheel 31, the second wheel 32, the first, second, and third driving gears 41, 42, 43, as well as the first, second, and third roller units 50, 60, 70.

Figure 5:
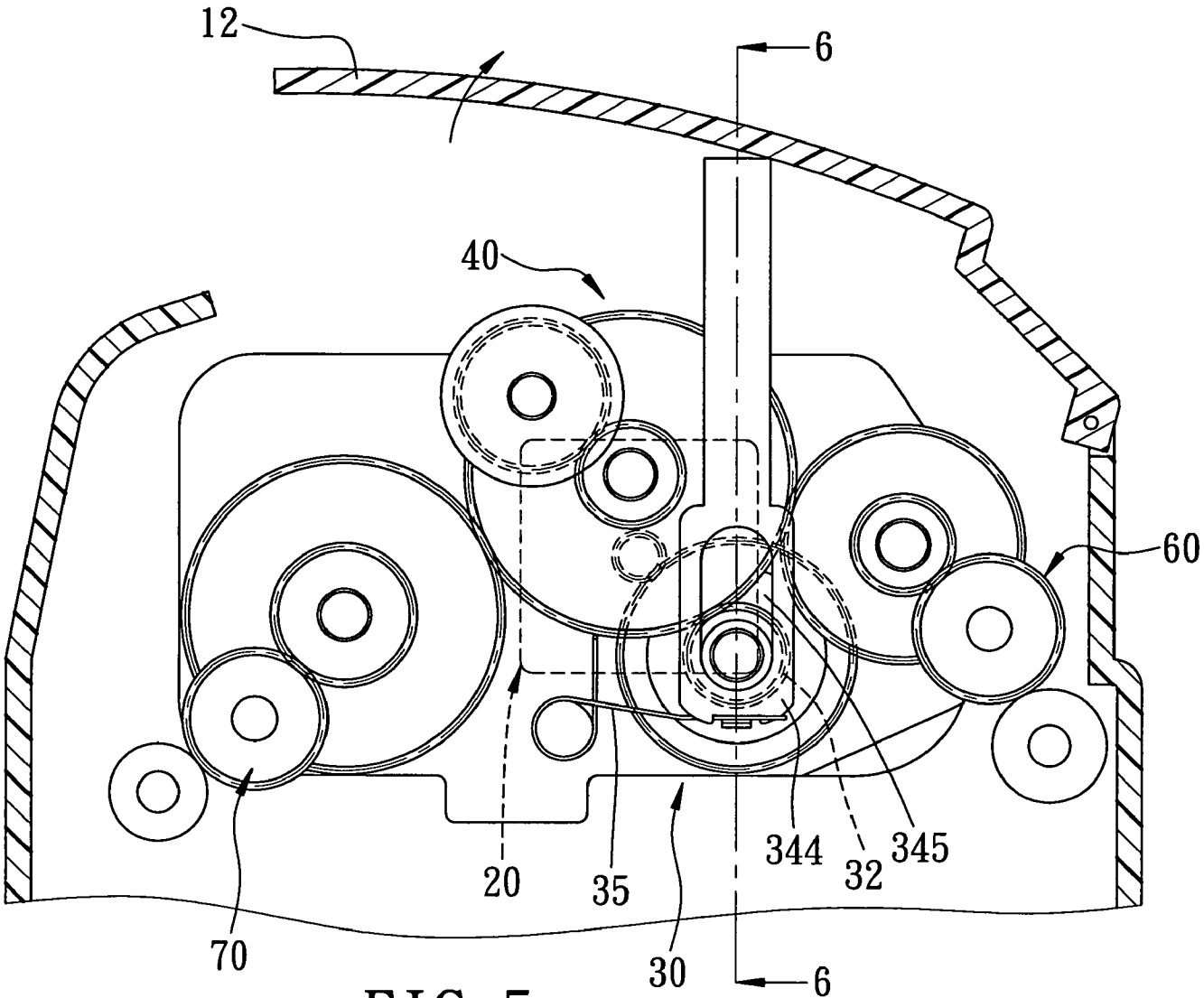
FIG. 5 is a fragmentary schematic sectional view of the preferred embodiment when the driving rod is disposed in a disconnecting position.
Figure 6:
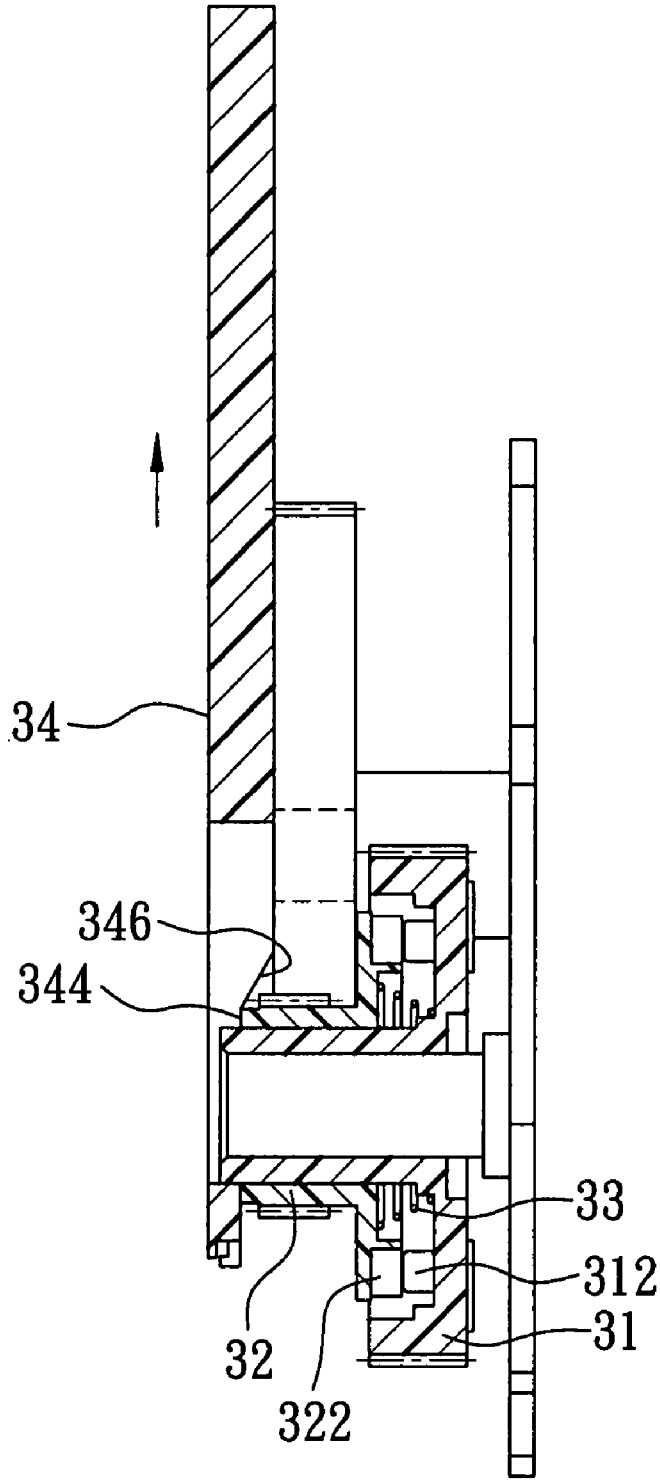
FIG. 6 is a sectional view taken along Line 6-6 in FIG. 5.

With particular reference to FIGS. 5 and 6, when a paper jam occurs, to remove a jammed sheet of paper, the top cover 12 is pivoted to an open position to thereby move the driving rod 34 to a disconnecting position due to the biasing action of the biasing member 35. In the disconnecting position, the second wheel 32 comes into contact with the thin rod portion 343 of the driving rod 34. As such, the second wheel 32 is removed from the first wheel 31 by the resilient member 33. Hence, the second engaging portions 322 of the second wheel 32 are disengaged respectively from the first engaging portions 312 of the first wheel 31 so as to interrupt the power connection between the first and second wheels 31, 32. As a result, the jammed sheet of paper can be removed easily from an assembly of the first, second, and third roller units 50, 60, 70. Thus, the object of this invention is achieved.

With this invention thus explained, it is apparent that numerous modifications and variations can be made without departing from the scope and spirit of this invention. It is therefore intended that this invention be limited only as indicated by the appended claims.

We claim:

1. An automatic document feeder comprising:

a housing unit;

a driving unit including a driving wheel;

a clutch unit disposed in said housing unit and including a first wheel driven by said driving wheel, a second wheel disposed in proximity to said first wheel, a resilient member interposed between said first and second wheels, and a driving rod, said first wheel having an engagement surface formed with a plurality of first engaging portions, said second wheel having an engagement surface formed with a plurality of second engaging portions aligned respectively with said first engaging portions of said first wheel, said resilient member being interposed between said engagement surfaces of said first and second wheels so as to bias said first and second wheels to move away from each other, said driving rod having a thick rod portion and a thin rod portion and being movable between a connecting position whereat said second wheel comes into contact with said thick rod portion of said driving rod and whereat said second engaging portions of said second wheel engage respectively said first engaging portions of said first wheel so as to allow for transfer of rotation of said first wheel to said second wheel, and a disconnecting position whereat said second wheel comes into contact with said thin rod portion of said driving rod and whereat said second engaging portions of said second wheel are disengaged respectively from said first engaging portions of said first wheel so as to prevent transfer of rotation of said first wheel to said second wheel;

a first roller unit driven by said second wheel;

a second roller unit driven by said second wheel; and a third roller unit driven by said second wheel.

2. The automatic document feeder as claimed in claim 1, wherein said driving rod is vertical, said housing unit including a housing body and a top cover disposed pivotally on said housing body, said resilient member biasing said driving rod to move upwardly to thereby abut against said top cover, said top cover being pivotable between a closed position whereat said driving rod is disposed in said connecting position, and an open position whereat said driving rod is disposed in said disconnecting position, said clutch unit further including a biasing member for biasing said driving rod to move from said connecting position to said disconnecting position.

3. The automatic document feeder as claimed in claim 2, wherein said biasing member is configured as a torsional spring, and is disposed pivotally on said housing unit, said biasing member having a first end abutting against said housing unit, and a second end abutting against a lower end of said driving rod.

4. The automatic document feeder as claimed in claim 1, further comprising a drive gear unit, said drive gear unit including a first driving gear driven by said second wheel so as to rotate said first roller unit, and a pair of second and third driving gears driven by said first driving gear so as to rotate said second and third roller units, respectively.

5. The automatic document feeder as claimed in claim 1, wherein said first roller unit is adapted to separate documents, said second roller unit being adapted to convey the documents, said third roller unit being adapted to eject the documents.

6. The automatic document feeder as claimed in claim 1, wherein said housing unit further includes a mounting plate disposed fixedly in said housing body such that said drive gear unit, said driving unit, said first wheel, and said first, second, and third roller units are disposed on said mounting plate.

7. The automatic document feeder as claimed in claim 1, wherein said first engaging portions of said first wheel are configured as cylindrical projections, said second engaging portions of said second wheel being configured as recesses.

8. The automatic document feeder as claimed in claim 1, wherein said driving rod further has an inclined guiding surface disposed between said thick and thin rod portions for guiding movement of said second wheel between said thick and thin rod portions of said driving rod.

9. The automatic document feeder as claimed in claim 1, wherein said first and second wheels are coaxial.

* * * * *